United States Patent [19]

Hiraga et al.

[11] 4,340,339

[45] Jul. 20, 1982

[54] SCROLL TYPE COMPRESSOR WITH OIL PASSAGEWAYS THROUGH THE HOUSING

[75] Inventors: Masaharu Hiraga, Honjo; Kiyoshi Terauchi, Isesaki, both of Japan

[73] Assignee: Sankyo Electric Company Limited, Isesaki, Japan

[21] Appl. No.: 121,116

[22] Filed: Feb. 13, 1980

[30] Foreign Application Priority Data

Feb. 17, 1979 [JP] Japan ..... 54/16744

[51] Int. Cl.[3] ..... F04C 18/02; F04C 29/02

[52] U.S. Cl. ..... 418/55; 418/88; 418/98

[58] Field of Search ..... 418/55, 88, 97–100

[56] References Cited

U.S. PATENT DOCUMENTS

| | | | |
|---|---|---|---|
| 3,833,318 | 9/1974 | Nakayama et al. | 418/100 |
| 3,865,515 | 2/1975 | Allen | 418/97 |
| 3,899,271 | 8/1975 | Glanvall | 418/100 |
| 3,924,977 | 12/1975 | McCullough | 418/55 |
| 3,986,799 | 10/1976 | McCullough | 418/55 |
| 3,994,633 | 11/1976 | Shaffer | 418/55 |
| 3,994,636 | 11/1976 | McCullough et al. | 418/55 |

*Primary Examiner*—John J. Vrablik

*Attorney, Agent, or Firm*—Hopgood, Calimafde, Kalil, Blaustein & Judlowe

[57] ABSTRACT

In a scroll type compressor unit including two interfitting fixed and orbiting scroll members in the compressor housing, a crank shaft projecting from the interior of the compressor housing and rotatably supported by a radial bearing, a crank pin on the inner end of the crank shaft on which the orbiting scroll member is rotatably supported by another radial bearing, and a rotation preventing mechanism for preventing the orbiting scroll member from rotating, an oil accumulating chamber is provided in the compressor housing to connect with the fluid inlet port of the compressor housing in order to lubricate those radial bearings and other moving parts. A shaft seal assembly is mounted on the crank shaft in a shaft seal cavity which is communicated with the oil accumulating chamber through a first oil passageway formed in the wall of the compressor housing. The compressor housing is provided with an oil deflector depending from its inner surface and a second oil passageway formed in the wall of the compressor housing to communicate between the interior of the compressor housing adjacent to the oil deflector and the oil accumulating chamber. The cool lubricating oil in the oil accumulating chamber circulates through the first oil passageway, shaft seal cavity, the interior of the compressor housing and the second oil passageway, lubricating the shaft seal assembly, the radial bearings, scroll members and other moving parts in the compressor housing.

7 Claims, 6 Drawing Figures

SCROLL TYPE COMPRESSOR WITH OIL PASSAGEWAYS THROUGH THE HOUSING

BACKGROUND OF THE INVENTION

This invention relates to fluid displacement apparatus, and in particular, to fluid compressor units of a scroll type.

A scroll type apparatus has been well known in the prior art as disclosed in, for example, U.S. Pat. No. 801,182, and others, which comprises two scroll members each having an end plate and a spiroidal or involute spiral element. These scroll members are so maintained angularly and radially offset that both of spiral elements interfit to make a plurality of line contacts between spiral curved surfaces thereby to seal off and define at least one fluid pocket. The relative orbital motion of these scroll members shifts the line contacts along the spiral curved surfaces and, therefore, the fluid pocket changes in volume. The volume of the fluid pocket increases or decreases in dependence on the direction of the orbital motion. Therefore, the scroll type apparatus is applicable to handle fluids to compress, expand or pump them.

As the scroll type compressor unit includes moving parts such as means for imparting the orbital motion of a scroll member, it requires any lubricating system for lubricating the moving parts.

Although various improvements in the scroll type compressors have been disclosed in many patents, for example, U.S. Pat. Nos. 3,884,599, 3,924,977, 3,994,633, 3,994,635, and 3,994,636, such a lubricating system is not almost proposed.

SUMMARY OF THE INVENTION

It is a specific object of this invention to provide a scroll type compressor unit having a reliable lubricating system for moving parts thereof.

It is another object of this invention to provide a scroll type compressor unit wherein moving parts are efficiently lubricated by cool oil.

It is still another object of this invention to provide a scroll type compressor unit with a lubricating system wherein a drive shaft is supported without deflection and vibration.

It is yet another object of this invention to provide a scroll type compressor unit which is simple in the construction and the production realizing the above described objects.

A scroll type compressor unit according to this invention includes a compressor housing having a fluid inlet port and a fluid outlet port. A fixed scroll member is fixedly disposed within the compressor housing and has first end plate means to which first wrap means are affixed. A first chamer is defined by the inner surface of the compressor housing and the first end plate means of the fixed scroll member and contains the first wrap means therein. An orbiting scroll member is orbitally disposed within the first chamber and has second end plate means to which second wrap means are affixed. The first and second wrap means are interfitting at an angular offset of 180° to make a plurality of line contacts to define at least one sealed off fluid pocket which moves with reduction of volume thereof by the orbital motion of the orbiting scroll member. Thus, the fluid in the pocket is compressed. A rear housing on the compressor housing is disposed adjacent to the first end plate means and has a suction chamber and a discharge chamber communicating with the inlet port and outlet port, respectively. The first end plate means are provided with a fluid intake hole for communicating between the first chamber and the suction chamber and with a fluid discharge port at a position corresponding to the center of the first wrap means for discharging the compressed fluid into the discharge chamber. The unit has first means including a drive shaft for imparting the orbital motion to the orbiting scroll member. A front housing on the compressor housing includes a first opening for receiving the drive shaft. A shaft seal cavity is disposed about a portion of the drive shaft. An oil deflector is formed on the inner surface of the compressor housing for directing oil flow along the inner surface of the compressor housing into an axial direction. An oil opening is formed in the inner surface of the compressor housing adjacent to an end of the oil deflector. A first oil passageway is formed in the compressor housing for communicating between the lower portion of the suction chamber and the shaft seal cavity. A second oil passageway is also formed in the compressor housing for communicating between the lower portion of the suction chamber and the oil opening. Therefore, the oil in the lower portion of the suction chamber flows into the shaft seal cavity through the first oil passageway and, therefrom, flows into the first chamber through the shaft receiving opening to lubricate moving parts within the first chamber. The oil in the first chamber is directed into the oil opening and, therefrom, flows into the lower portion of the suction chamber through the second oil passageway.

The first oil passageway is formed to extend through the wall of the compressor housing including the front housing and the rear housing. While the second oil passageway is formed to extend through a portion of the wall of the compressor housing and the first end plate of the fixed scroll member.

The drive shaft is rotatably supported in the shaft receiving opening by a first radial bearing means. The oil in the shaft seal cavity flows into the first chamber through the first radial bearing means and lubricates the bearing means.

The first means comprise a disk rotor mounted on an inner end of the drive shaft and supported by first thrust bearing means on an inner surface of the front housing. A drive pin is formed to axially project from a rear surface of the disk rotor member and to be radially offset from the drive shaft. An axial boss is formed on a surface of the second end plate means opposite to the second wrap means and is mounted on the drive pin. Second radial bearing means are fitted into the axial boss to rotatably support the drive pin in the axial boss. The disk rotor member is provided with an oil hole which extends from a position adjacent to the first radial bearing means to an opposite position adjacent to the second radial bearing means. Therefore, a part of the oil which flows into the first chamber through the first radial bearing means flows through the oil hole to lubricate the second radial bearing means.

Further objects, features and other aspects of this invention will be understood from the following detailed description of the preferred embodiments of this invention referring to the annexed drawings.

DETAILED DESCRIPTION OF PREFERRED EMBODIMENTS

Figure 1:
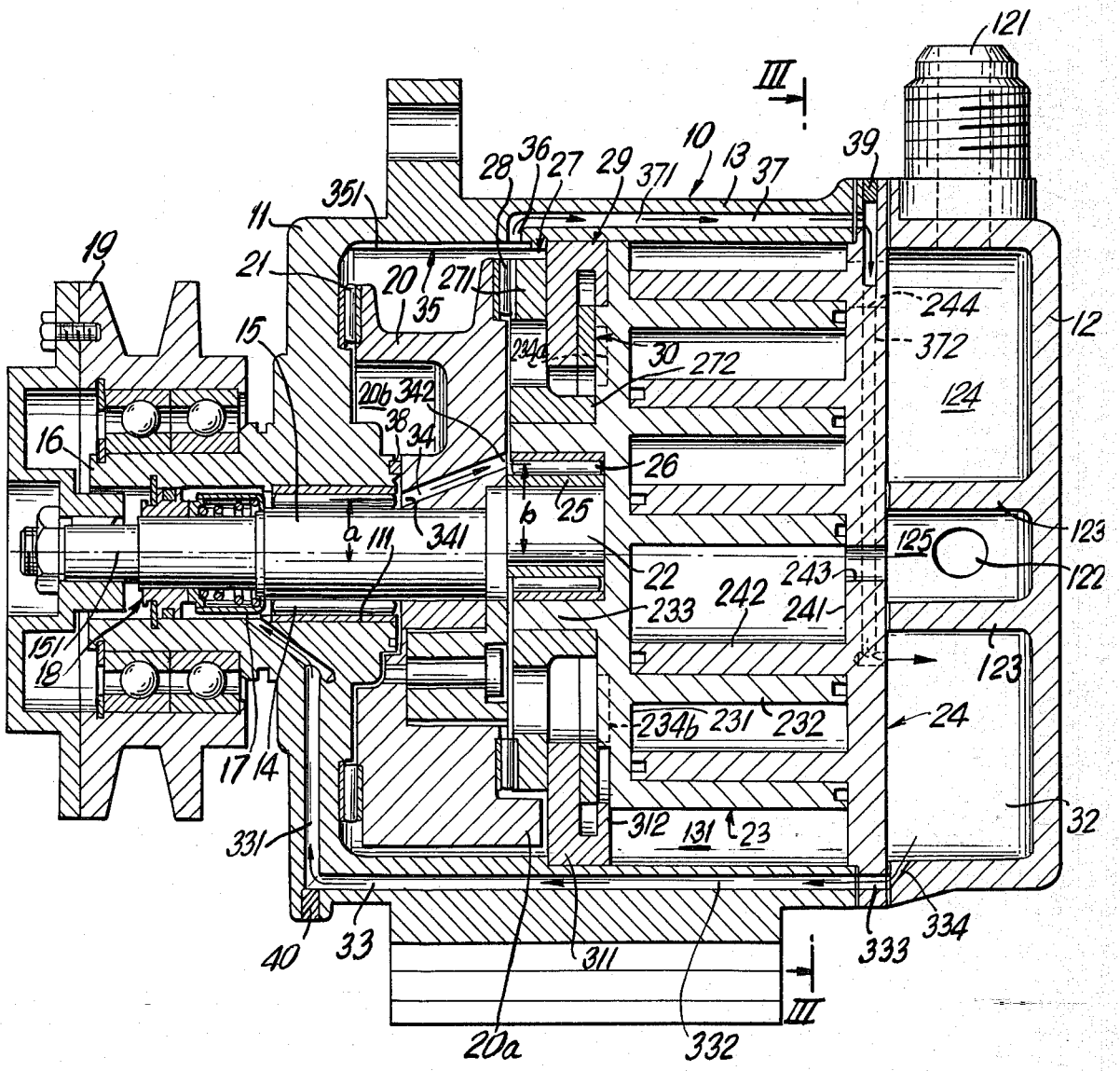
FIG. 1 is a vertical sectional view of a compressor unit of an embodiment of this invention.

Referring to FIG. 1, a refrigerant compressor unit 10 of an embodiment shown includes a compressor housing comprising a front housing 11, a rear housing 12 and a cylindrical housing 13 connecting between those front and rear housings. Front housing 11 is shown formed integral with cylindrical housing 13. The compressor housing defines a sealed off chamber therein which communicates outside the compressor housing through a fluid inlet port 121 and a fluid outlet port 122 formed in rear housing 12. A drive shaft 15 is rotatably supported by a radial needle bearing 14 is an opening 111 formed in housing 11. Front housing 11 has a sleeve portion 16 projecting on the front surface thereof and surrounding drive shaft 15 to define a shaft seal cavity 17. A shaft seal assembly 18 is assembled on drive shaft 15 within shaft seal cavity 17. Drive shaft 15 is driven by an external drive power source (not shown) through a rotational force transmitting means such as a pulley 19 connected with drive shaft 15 and belt means connecting between pulley 19 and the external drive power source. A disk rotor 20 is fixedly mounted on an inner end of drive shaft 15 and is born on the inner surface of front housing 11 through a thrust needle bearing 21 which is disposed concentric with drive shaft 15. Rotor 20 is provided with a balance weight 20*a* and balance hole 20*b* to compensate the dynamic unbalance. A crank pin or a drive pin 22 is also connected to the inner end of drive shaft 15 to axially project from the rear end surface of rotor 20. Drive pin 22 is radially offset from drive shaft 15 by a predetermined length and is formed integral with drive shaft 15 in the shown embodiment.

Reference numerals 23 and 24 represent a pair of interfitting orbiting and fixed scroll members. Orbiting scroll member 23 includes an end circular plate 231 and a wrap means or spiral element 232 affixed onto one end surface of circular plate 231. Circular plate 231 is provided with an axial boss 233 projecting from the other end surface thereof. Drive pin 22 is fitted into boss 233 with a bush 25 and a radial needle bearing 26 therebetween, so that orbiting scroll member 23 is rotatably supported on drive pin 22.

A hollow member 27 having a radial flange 271 is fitted onto boss 233 non-rotatably by means of key and keyway connection. Radial flange 271 is supported on the rear end surface of disk rotor 20 by a thrust needle bearing 28 which is disposed concentric with drive pin 22. The axial length of hollow member 27 is equal to, or more than, the axial length of boss 233, so that the thrust load from orbiting scroll member 23 is supported on front housing 11 through disk rotor 20. Therefore, the rotation of drive shaft 15 effects the orbital motion of orbiting scroll member 23 together with hollow member 27. Namely, orbiting scroll member 23 moves along a circle of a radius of the length between drive shaft 15 and drive pin 22.

Means 29 for preventing orbiting scroll member 23 from rotating during its orbital motion is disposed between circular plate 231 of orbiting scroll member 23 and radial flange 271 of hollow member 27.

Figure 2:
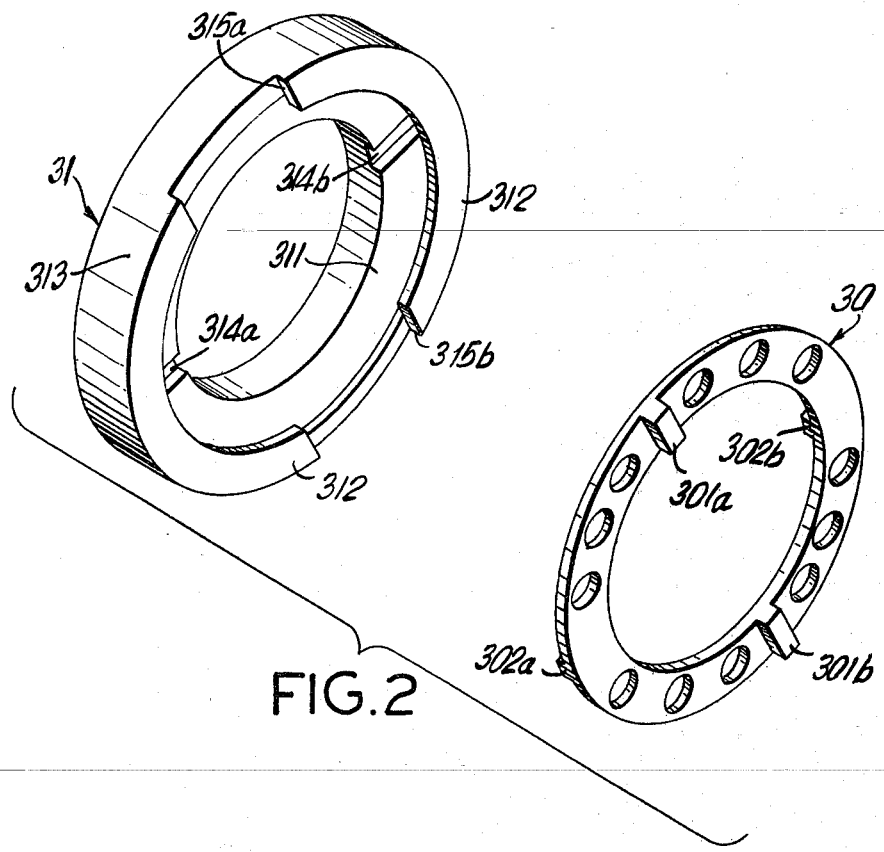
FIG. 2 is a perspective view of a rotation preventing mechanism in the embodiment of FIG. 1.

Referring to FIGS. 1 and 2, rotation preventing means 29 will be described. Orbiting scroll member 23 is provided with a pair of keyways 234*a* and 234*b* in the front end surface of circular plate 231 which are formed at both sides of boss 233 along a diameter. An Oldham ring 30 is disposed around a cylindrical portion 272 of hollow member 27. Oldham ring 30 is provided with a first pair of keys 301*a* and 301*b* on the surface opposite to the front end surface of circular plate 231, which are received in keyways 234*a* and 234*b*. Oldham ring 30 is also provided with a second pair of keys 302*a* and 302*b* on its opposite surface. Keys 302*a* and 302*b* are arranged along a diameter perpendicular to the diameter along which keys 301*a* and 301*b* are arranged. An annular member 31 is disposed around cylindrical portion 272 of hollow member 27 and between radial flange 271 and circular end plate 231, and is non-rotatably secured to the inner surface of cylindrical housing 13 by key means. Annular member 31 comprises an annular plate portion 311, a ring plate portion 312 and a cylindrical side wall portion 313 connecting between annular plate portion 311 and ring plate portion 312 at their entire ends. The axial outer end surface of ring plate portion 312 is in contact with the front end surface of circular plate 231 of orbiting scroll member 23. Annular plate portion 311 is provided with a pair of keyways 314*a* and 314*b* in the axial inner surface for receiving keys 302*a* and 302*b*. Oldham ring 30 is disposed in a hollow space between annular plate portion 311 and ring plate portion 312. Ring plate portion 312 is provided with cut away portions 315*a*and 315*b* for permitting keys 301*a*and 301*b* of Oldham ring 30 to be received in keyways 234*a* and 234*b* of circular plate 231 of orbiting scroll member 23 and to move in a radial direction. Therefore, Oldham ring 30 is slidable in a radial direction by the guide of keys 302*a* and 302*b* by keyways 314*a* and 314*b* but is prevented from rotation. And orbiting scroll member 23 is slidable in the other radial direction by the guide of keys 301*a* and 301*b* by keyways 234*a* and 234*b*, but is prevented from rotation. Accordingly, orbiting scroll member 23 is prevented from rotation, but is permitted to move in two radial directions perpendicular to one another. Therefore, since orbiting scroll member 23 is permitted to move along a circular orbit as a result of movement in the two radial directions but is prevented from rotation, it effects the orbital motion without rotation by the eccentric movement of drive pin 22 by the rotation of drive shaft 15.

The other fixed scroll member 24 also comprises an end circular plate 241 and a wrap means or spiral element 242 affixed on one end surface of the circular plate. Circular plate 241 is provided with a hole or a discharge port 243 formed at a position corresponding to the center of spiral element 242. Fixed scroll member 24 is fixedly disposed in the compressor housing by interposing end plate 241 between rear housing 12 and cylindrical housing 13 and by securing the end plate to them by bolt means (not shown), with an orientation that the outer terminal end of spiral element 242 is disposed on a lower side. Therefore, a chamber 131 is defined by circular end plate 241, cylindrical housing 13 and front housing 11. Fixed spiral element 242 is disposed within chamber 131 and fits with orbiting spiral element 232.

Rear housing 12 is provided with an annular projection 123 on its inner surface to partition a suction chamber 124 and a discharge chamber 125. The axial projecting end surface of annular projection 123 is in tight contact with the rear end surface of circular plate 241 of fixed scroll member 24 around discharge port 243, so that discharge port 243 connects with discharge chamber 123. Suction chamber 124 and discharge chamber 125 are connected to inlet port 121 and the outlet port 122, respectively.

Figure 3:
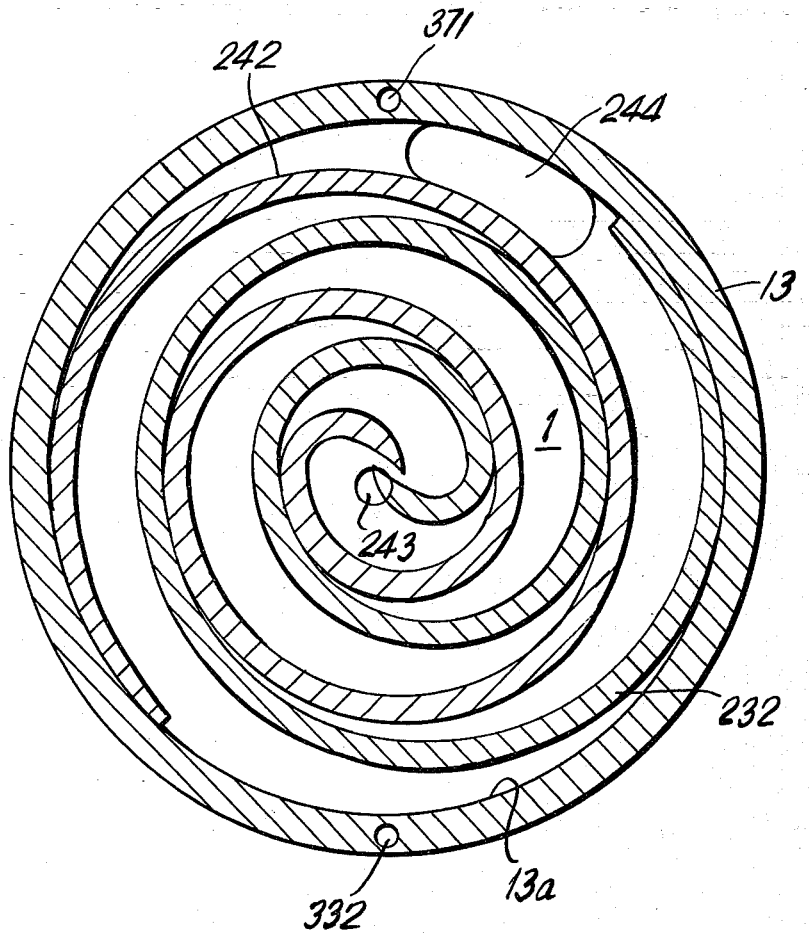
FIG. 3 is a sectional view taken along a line III—III in FIG. 1.
Figure 5:
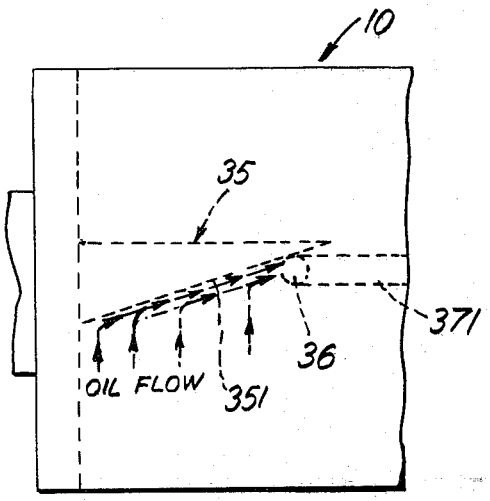
FIG. 5 is a plan view of the upper front portion of the compressor showing the oil flow therethrough.
Figure 6:
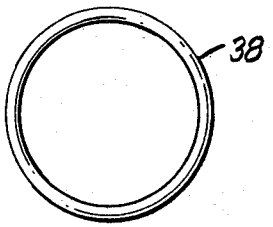
FIG. 6 is a plan view of seal ring 38.

Referring to FIG. 3 in addition to FIG. 1, circular plate 241 is also provided with another hole 244 at a position outside spiral element 242 and on a side opposite to the outer terminal end of spiral element 242 in reference to center hole 243. Therefore, hole 244 is disposed on an upper side and adjacent to the outer terminal end of spiral element 232 of orbiting scroll member 23. Accordingly, chamber 131 defined within the interior of the compressor housing by circular end plate 241 is connected with suction chamber 124 through hole 244. Hole 244 is shown crescent-shaped.

In the above described compressor, when drive shaft 15 is rotated by an external drive power source (not shown), drive pin 22 moves eccentrically to effect the orbital motion of orbiting scroll member 23. At a time, the rotation of orbiting scroll member 23 is prevented by rotation preventing means 29. Therefore, fluid, or refrigerant gas, introduced into chamber 131 through inlet port 121, suction chamber 124 and hole 244 is taken into fluid pockets (1, in FIG. 3) formed between both scroll members 23 and 24, and is gradually compressed because fluid pockets gradually shift towards the center with the reduction of their volume by the orbital motion of orbiting scroll member 23. The compressed fluid is discharged into discharge chamber 125 through hole 243, and, therefrom, discharged through outlet port 122 to, for example, a cooling circuit. The fluid returns into chamber 131 through inlet port 121, suction chamber 124 and hole 244.

A part of the fluid introduced into chamber 131 through hole 244 flows into a space between the outer terminal end of spiral element 232 and the adjacent side surface of spiral element 242, because hole 244 is disposed adjacent to the outer terminal end of spiral element 232. And the fluid is taken into a fluid pocket which is formed by the orbital motion of orbiting scroll member 23, and is compressed by further motion of orbiting scroll member 23.

The other part of the fluid flows between the outer terminal end portion of spiral element 232 and the inner surface (13*a* in FIG. 3) of cylindrical housing 13 to the outer terminal end portion of spiral element 242 of fixed scroll member 24 by the motion of orbiting scroll member 23. The fluid flows into a space between the outer terminal end portion of spiral element 242 and the adjacent surface of spiral element 232, and is taken into another pocket which is formed by the orbital motion of orbiting scroll member 23. Thereafter, the fluid is compressed by further motion of orbiting scroll member 23.

The fluid sent to the outer terminal end portion of fixed spiral element 242 through a space between orbiting spiral element 232 and the inner surface 13*a* of cylindrical housing 13 is pre-compressed in the space because ring plate portion 312 is in contact with end plate 231 of orbiting scroll member 23. Therefore, the compressing ratio is increased.

Figure 4:
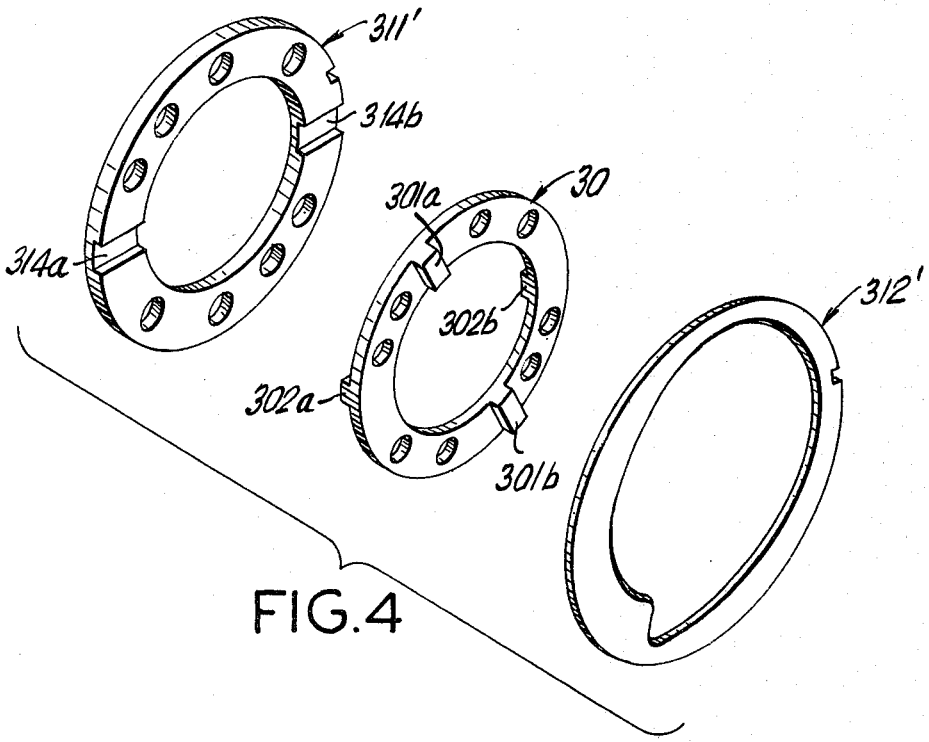
FIG. 4 is a perspective view of a modified rotation preventing mechanism.

As ring plate portion 312 is for enhancing the pre-compression, it may not be formed integral with annular member 31 but be formed as a separate part as a ring plate 312' as shown in FIG. 4. In the case, the annular member is formed as an annular plate 311'. In FIG. 4, similar parts are represented by the same reference characters as in FIG. 2.

The compressor unit 10 is provided with a lubricating system for lubricating shaft seal assembly 18, radial bearings 14 and 25, thrust bearings 21 and other moving parts.

The lower portion 32 of suction chamber 124 is used as a chamber for accumulating a lubricating oil. An oil passageway 33 is formed in the compressor housing for connecting oil accumulating chamber 32 and shaft seal cavity 17. Oil passageway 33 comprises an oil hole 331 formed in front housing to extend from shaft seal cavity 17 to the lower end thereof. Cylindrical housing 13 is formed with an axial oil hole 332 at its lower portion to connect with oil hole 331. End plate 241 is also formed with an axial oil hole 333 to connect with oil hole 332. Rear housing 12 is formed with a hole or a cut away portion 334 for connecting oil hole 333 and the bottom of oil accumulating chamber 32. Therefore, oil accumulating chamber 32 and shaft seal cavity 17 are communicated with one another through those oil holes 331–334.

Shaft seal cavity 17 is communicated with inner chamber 131 of the compressor housing through gaps in radial needle bearing 14.

Disk rotor 20 is provided with an oil hole 34 formed therein over its front end surface and its rear end surface. An opening 341 of it at the front end surface is adjacent the radial needle bearing 14 and the opposite opening 342 is adjacent to the other radial needle bearing 26. The distance a from the central axis 151 of drive shaft 15 to the front opening 341 of oil hole 34 is shorter than the distance b from the central axis 151 of drive shaft 15 to the other rear end opening 342 of oil hole 34. Therefore, the gap between the inner end surface of front housing 11 and disk rotor 20 and the rear opening 341 of oil hole 34 are lowered in the pressure in comparison with oil accumulating chamber 32 upon the rotation of shaft 15 because of the centrifugal force due to the rotation of rotor 20. Therefore, the lubricating oil in oil accumulating chamber 32 flows into the gap between the inner end surface of front housing 11 and disk rotor 20 through oil passageway 33, shaft seal cavity 17 and radial needle bearing 14. Accordingly, shaft seal assembly 18 and radial needle bearing 14 are lubricated. A part of the lubricating oil flowing into the gap between the inner surface of front housing 11 and disk rotor 20 flows radially outwardly in the gap by the centrifugal force due to the rotation of disk rotor 20 to lubricate thrust bearing 21. On the other hand, the other oil flows in oil hole 34 towards radial bearing 26, and a pair of it lubricates bearing 26 and the other part flows radially outwardly by the centrifugal force due to the rotation of rotor 20 and the orbital motion of orbiting scroll member 23 and hollow member 27 to lubricate thrust bearing 28. The oil after lubricating thrust bearings 21 and 28 is accumulated in the bottom portion of chamber 131, and is splashed by the rotation of rotor 20 and the orbital motion of orbiting scroll member 23. Therefore, the contact portion between orbiting scroll member 23 and fixed scroll member 24, keys 301*a*–302*b* and keyways 234*a*, 234*b*, 314*a* and 314*b* and other moving parts are lubricated. While, the oil attached to, and flowing on, the inner surface of cylindrical portion 13 is brought back to oil accumulating chamber 32.

An oil deflector 35 is formed on the inner surface of cylindrical housing 13 to depend from the inner surface into the chamber. Oil deflector 35 is a projection from the inner surface of cylindrical housing 13 at a position generally over disk rotor 20. The projection extends generally in an axial direction and has an axial side surface 351 inclined from the axial direction. Therefore, the oil flowing downwardly on the inner surface is deflected and directed in an axial direction by deflector 35 and flows along side surface 351 towards its end.

Oil deflector may be formed as an axial groove in the inner surface of cylindrical housing 13. The oil flowing on the inner surface flows into the groove and, therefrom, flows in an axial direction in the groove to its axial end.

An oil opening 36 is formed in the inner surface of cylindrical housing 13 adjacent to the end of oil deflector 35. An oil passageway 37 is formed in the compressor housing to communicate between oil opening 36 and oil accumulating chamber 32. Oil passageway 37 comprises an axial oil hole 371 formed in cylindrical housing 13 at its upper wall portion and connecting with oil opening 36. Another oil hole 372 is formed in circular end plate 241 to extend radially from an upper peripheral portion adjacent to oil hole 371 to the portion adjacent to the upper portion of oil accumulating chamber 32. Thus, oil hole 371 is connected to oil accumulating chamber 32 through oil hole 372.

The oil flowing on the inner surface of cylindrical housing 13 is collected and directed to oil opening 36 by oil deflector 35, and flows therefrom through oil holes 371 and 372 into oil accumulating chamber 32. The oil is again sent to shaft seal cavity 17 through oil passageway 33. Thus, the lubricating oil in oil accumulating chamber 32 circulates through oil passageway 33, shaft seal cavity 17, radial needle bearing 14, inner chamber 131, oil deflector 35, oil opening 36 and oil passageway 37, and lubricates radial needle bearings 14 and 26, thrust bearings 21 and 28 and other moving parts.

A part of oil splashed by moving parts such as rotor 20 and orbiting scroll member 23 strays within the chamber 131 as oil mist. The oil mist attaches on parts in the chamber 131 to lubricate them and is also taken into fluid pockets together with the fluid. The oil mist is discharged from discharge port 243 to discharge chamber 125 together with the compressed fluid and returns to suction chamber 124 after circulating the external fluid circuit. The oil mist adheres on the inner surface of suction chamber 124 and flows down to oil accumulating chamber. The oil is again used to lubricate moving parts as described above.

Since the fluid in suction chamber 124 is cool, the oil in accumulating chamber 32 is also cool. Therefore, moving parts are always lubricated by the cool lubricating oil so that the life of those parts can be extended.

In order to secure the sufficient oil amount flowing through oil hole 34 into radial bearing 26, an oil sealing ring 38 is disposed in the gap between the inner surface of front housing 11 and disk rotor 20 so that the oil amount flowing radially outwardly in the gap is reduced. Oil sealing ring 38 is made of a rubber ring.

Plugs 39 and 40 are for sealing and closing openings which are formed at perforation of oil holes 372 and 331. The loading or feeding and drawing of oil can be performed through the openings after removing plugs 39 and 40.

This invention has been described in detail in connection with preferred embodiments, but these are example only and this invention is not restricted thereto. It will be easily understood by those skilled in the art that the other variations and modifications can be easily made within the scope of this invention.

What is claimed is:

1. In a scroll type compressor unit including a compressor housing having a fluid inlet port and a fluid outlet port, a fixed scroll member fixedly disposed within said compressor housing and having first end plate means to which first wrap means are affixed, a first chamber defined by the inner surface of said compressor housing and said first end plate means of said fixed scroll member and containing said first wrap means therein, an orbiting scroll member orbitally disposed within said first chamber and having second end plate means to which second wrap means are affixed, and said first and second wrap means interfitting at an angular offset of 180° to make a plurality of line contacts to define at least one sealed off fluid pocket which moves with reduction of volume thereof by the orbital motion of said orbiting scroll member, thereby to compress the fluid in the pocket, the improvement which comprises a rear housing on said compressor housing disposed adjacent to said first end plate means and having a suction chamber and a discharge chamber communicating with said inlet port and outlet port, respectively, said first end plate means provided with a fluid intake hole for communicating between said first chamber and said suction chamber and with a fluid discharge port at a position corresponding to the center of said first wrap means for discharging the compressed fluid into said discharge chamber, first means including a drive shaft for imparting the orbital motion to said oribiting scroll member, a front housing on said compressor housing including a first opening for receiving said drive shaft, a shaft seal cavity disposed about a portion of said drive shaft, oil deflector means for directing oil flow along the inner surface of said compressor housing into an axial direction, an oil opening formed in the inner wall of said compressor housing adjacent to an end of said oil deflector means, a first oil passageway communicating between a lower portion of said suction chamber and said shaft seal cavity, and a second oil passageway communicating between said oil opening and said lower portion of said suction chamber, whereby the oil in said lower portion of said suction chamber flows into said first chamber through said first oil passageway, shaft seal cavity and said shaft receiving opening to lubricate moving parts in said first chamber and returns into said lower portion of said suction chamber through said oil deflector means, said oil opening and said second oil passageway.

2. The improvement as claimed in claim 1, wherein said second oil passageway comprises a first oil hole formed in the wall of said compressor housing and a second oil hole formed in said first end plate of said fixed scroll member.

3. The improvement as claimed in claim 1, wherein said first oil passageway is formed in the wall of said compressor housing.

4. The improvement as claimed in claim 1, which further comprises first radial bearing means mounted in said opening of said front housing and for supporting said drive shaft, the oil in said shaft seal cavity flowing into said first chamber lubricating said first radial bearing means.

5. The improvement as claimed in claim 4, in which said first means comprises a disk rotor member mounted on an inner end of said drive shaft and supported by first thrust bearing means on an inner surface of said front housing, a drive pin axially projecting from a rear surface of said disk rotor member and being radially offset from said drive shaft, an axial boss formed on a surface of said second end plate means opposite to said second wrap means and mounted on said drive pin, second radial bearing means for rotatably supporting said axial boss on said drive pin, and a third oil hole formed in said disk rotor member which extends from a position adjacent to said first radial bearing means to an opposite position adjacent to said second radial bearing means, whereby a part of the oil which flows into said first chamber through said first radial bearing means flows through said third oil hole to lubricate said second radial bearing means.

6. The improvement as claimed in claim 5, wherein a distance from an opening of said third oil hole adjacent to said first radial bearing from the central axis of said drive shaft is shorter than a distance from an opposite opening of said third oil hole adjacent to said second radial bearing to the central axis of said drive shaft.

7. The improvement as claimed in claim 6, which further comprises oil flow sealing means disposed in a gap between the inner surface of said front housing and said disk rotor and for sealing oil flow in said gap.

* * * * *